United States Patent [19]

Gaia et al.

[11] Patent Number: 4,831,353

[45] Date of Patent: May 16, 1989

[54] CABLE FUSE

[75] Inventors: Aldino J. Gaia, St. Louis; Frank Suher, Chesterfield; Robert Douglass, Kirkwood; Arlie Ehlmann, Barnhart; Angelo Urani, Ellisville, all of Mo.

[73] Assignee: Cooper Industries, Inc., Houston, Tex.

[21] Appl. No.: 103,243

[22] Filed: Sep. 30, 1987

[51] Int. Cl.[4] ..... H01H 85/14; H01H 85/22

[52] U.S. Cl. ..... 337/255; 337/264; 29/623

[58] Field of Search ..... 337/255–264, 337/163–166; 29/623

[56] References Cited

U.S. PATENT DOCUMENTS

| | | | |
|---|---|---|---|
| 2,004,191 | 6/1935 | Bussmann | 337/163 |
| 3,291,943 | 12/1966 | Kozacka | 337/163 |
| 4,067,103 | 1/1978 | Ciesmier | 337/264 |
| 4,131,869 | 12/1978 | Schmidt et al. | 337/264 |
| 4,150,354 | 4/1979 | Namitokov et al. | 337/295 |
| 4,349,804 | 9/1982 | Gaia | 337/295 |
| 4,394,638 | 7/1983 | Sian | 337/264 |
| 4,504,816 | 3/1985 | Viola et al. | 337/255 |
| 4,570,147 | 2/1986 | Ebi | 337/295 |
| 4,580,124 | 4/1986 | Borzoni | 337/264 |

*Primary Examiner*—H. Broome

*Attorney, Agent, or Firm*—Nelson A. Blish; Eddie E. Scott; Alan R. Thiele

[57] ABSTRACT

An automobile fuse (10) for use in extreme temperature conditions such as the engine compartment of an automobile. Fuse (10) is a blade-type fuse with loads (42, 44) on fusible element (40) providing time delay characteristics to match the insulation damage curves of small diameter automobile cable harnesses. The lower portions of terminals (20) and (30) have been selectively plated with silver. The outer housing (50) has been laser etched.

36 Claims, 4 Drawing Sheets

CABLE FUSE

FIELD OF THE INVENTION

The present invention relates to fuses in general and in particular to automotive fuses of the type that are used in an environment subject to temperature extremes such as the engine compartment of an automobile.

BACKGROUND OF THE INVENTION

Current practice in the automobile industry is to protect electrical and electronic equipment installed in automobiles by mean of fuses located in the fuse block in the glove compartment or under the dashboard of the automobile. These fuses are, for the most part, relatively low amperage and are designed to protect apparatus such as radios, lights, and turn signals. Also, these fuses operate in a temperature controlled environment since they are inside the passenger compartment of a car.

Many of the major electrical loads in an automobile are found underneath the hood of a car, such as the starter alternator, and the battery, to name several. These electrical apparatus draw relatively high currents compared to the typical fuse located under the dashboard. If these underhood electrical apparatus were to be protected by fuses mounted in the passenger compartment, the wiring connected to them would have to be routed through the firewall to the passenger compartment to the fuseblock and then back through the firewall to the component under the hood. This, of course, would add weight to the automobile, additional labor costs, and increase the cost of production. It is, therefore, desirable to locate some circuit protector under the hood of automobiles.

The automotive industry, in order to achieve weight reduction, is using smaller electrical cables with higher temperature insulation. A protective device to prevent the high temperature insulation from degrading due to high currents would have to open before cable insulation reaches damaging temperatures but not open on short duration current, overloads. Therefore, the automotive fuse must have certain time delay characteristics.

This fuse, or protective device, would need to operate in the engine compartment of an automobile where the ambient temperatures may range from a low of −40° C. to a high of 145° C. Because of these high temperatures it is desirable to have the plug-in terminals of fuses used to protect under-the-hood electrical equipment made of silver or plated with silver. The reason for this is that silver provides excellent electrical properties and also the oxide of silver are electrically conductive. However, if silver is used on the fusible element portion of the fuse, it will form a skin which adversely effects certain characteristics, such as ampacity, ampere capacity, of the fuse.

Other manufacturers have attempted to meet the requirements for silver plating on the fuse terminal portion without having silver plating on the fusible element by skiving or mechanically removing the silver plating from the fusible element. This is both time-consuming and adds additional costs to the manufacturing process. Other attempts to deal with the silver plating on the fusible element have used a slug or metal insert on the fusible element to compensate for the change in characteristics of the fusible element caused by the silver plating.

Another problem encountered in the manufacturing of large automotive fuses for use under the hood of automobiles has been marking an identification number or amperage rating on the fuses. In prior art methods, the fuse rating has been hot stamped onto the fuse housing. Because of the high temperature housing materials required in large automotive fuses, this has not been proved to be entirely satisfactory.

SUMMARY OF THE INVENTION

According to the present invention, a large automotive fuse is comprised of a metal element having a first and second terminal connected by a fusible element. The metal element is selectively plated so that plating occurs only on the lower portions of the terminal. Thus, there is no need to remove silver plating from the fusible element by skiving or to incorporate a metal slug to compensate for the plating. In one embodiment, the automotive fuse incorporates a load or heat sink on the fusible element. The heat sink is formed by folding over at least one elongated section on the fusible element. The metal element of the automotive fuse is enclosed in a insulating material made of transparent, high-temperature thermoplastic. The thermoplastic material is laser etched to identify the amperage rating of the fuse and provide date coding for positive identification and traceability for quality assurance purposes.

DETAILED DESCRIPTION OF THE DRAWING

Figure 2:
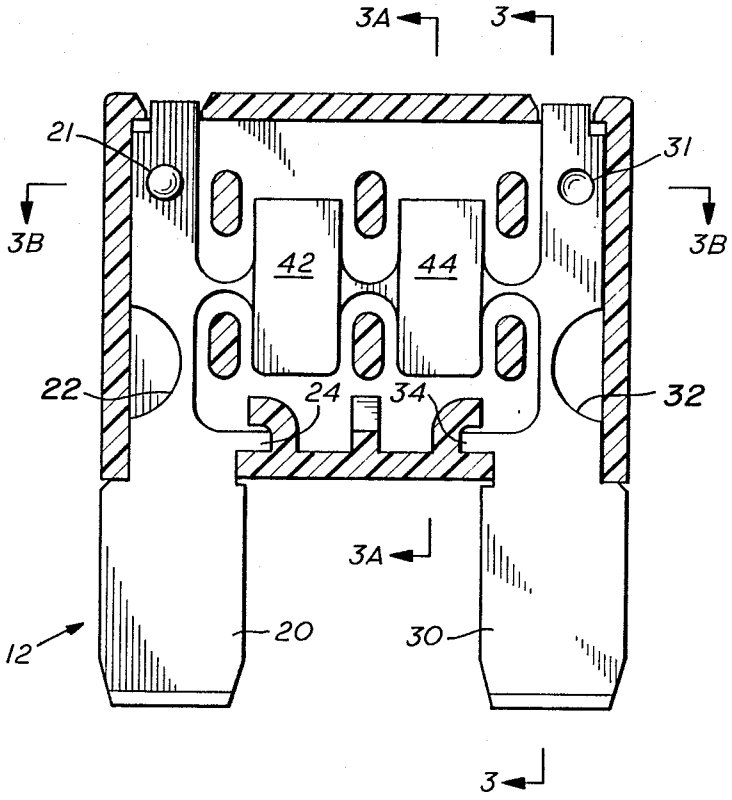
FIG. 2 is a sectional view of the automotive fuse shown in FIG. 1.
Figure 1:
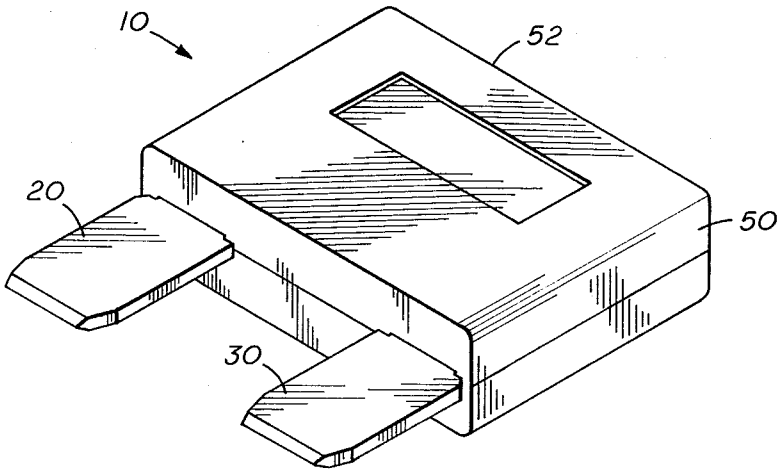
FIG. 1 is a perspective view of a large, automotive fuse according to the present invention.

A large, automotive fuse, shown in FIGS. 1 through 4, is designated generally by the numeral 10. Fuse 10 is comprised of a one piece metal element 12 and an insulating housing 50. Metal element 12 is comprised of a first terminal 20 and a second terminal 30, connected by fusible element 40. Fusible element 40 and the upper portions of first terminal 20 and second terminal 30 are encased in an insulating material 50.

Metal element 12 is preferably stamped from a single piece of conductive material such as zinc alloy. Other metals such as copper, silver, aluminum, or alloys of these would also be suitable. A notch 22 in first terminal 20 and notch 32 in second terminal 30, plus the weak spots 41, 43 and 45 in the fusible element 40, changes the current rating characteristics of the fuse by reducing the amount of metal in the fuse.

Figure 5:
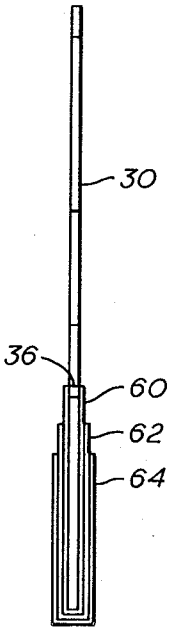
FIG. 5 is a plan view, from the side, of the metal element shown in FIG. 4.
Figure 4:
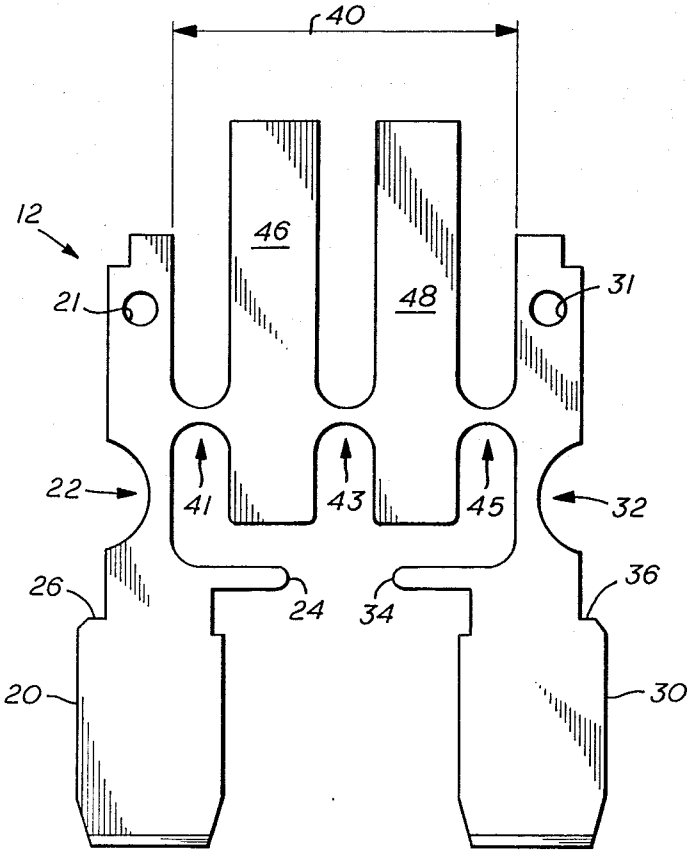
FIG. 4 is a plan view, from the front, of the metal element of a fuse according to the present invention.

In order to meet performance requirements for fuses of this type, the lower portions of terminals 20 and 30 must be plated. For the plating process, the upper portion of metal element 12 above shoulders 26 and 36 is masked, such as with masking tape, mechanical means, with a wax coating or other masking means such as are known in the art. The lower ends of terminals 20 and 30 are then coated with a copper plate undercoat 60, shown in FIG. 5. The copper plating and the other subsequent coats may be applied by dipping, spraying, vapor deposition, or other mean such as are well known in the art. Partial immersion such as dipping the lower part of metal element 12 in a plating solution would also be suitable. The copper coating thickness is between 50 and 100 micro inches thick in the preferred embodiment. A nickel barrier 62 is then applied, followed by a silver overcoat 64. Both the nickel barrier and silver overcoat are each on the order of 50–100 micro inches thick.

Figure 6:
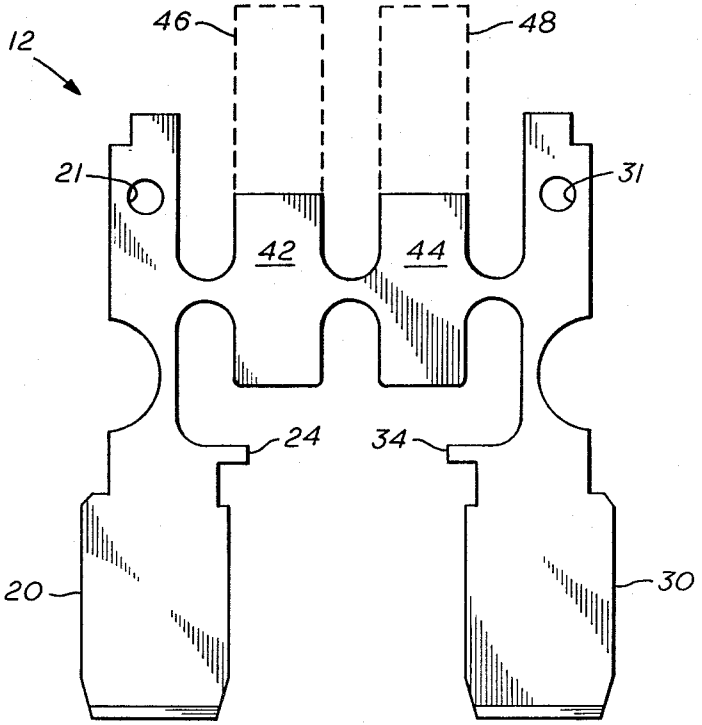
FIG. 6 is a plan view, partially in phantom, showing the fold lines of the present invention.
Figure 9:
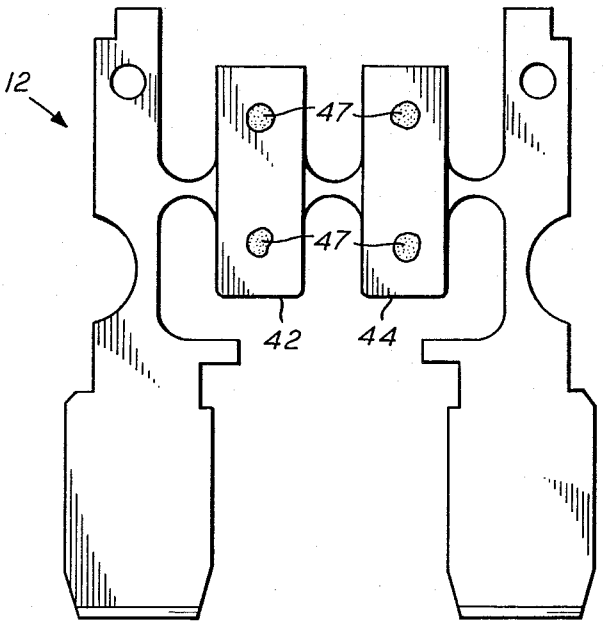
FIG. 9 is an alternate embodiment of the metal element of the fuse with the load elements welded to the fusible elements.
Figure 8:
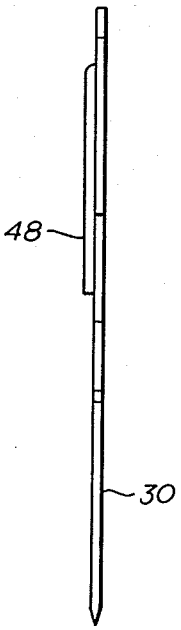
FIG. 8 is a side view of the metal element of the fuse, shown in FIG. 6, with the load element fully folded.
Figure 7:
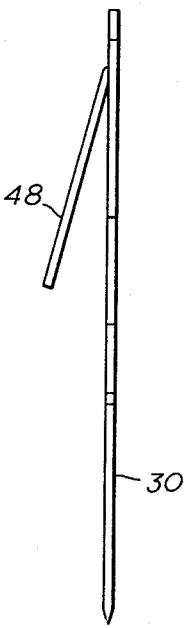
FIG. 7 is a side view of the metal element of the fuse, shown in FIG. 6, with the load element partially folded.

The elongated portion of the fusible element 46 and 48, shown in phantom in FIG. 6 are folded back upon themselves to achieve certain heat sink characteristics for time delay purposes. The size of the fold determines the time delay characteristics. FIG. 7 shows upper portion 48 partially folded back onto fusible element and FIG. 8 shows 48 completely folded back. The entire folded over portion of the fusible element comprises loads 42 and 44 shown in FIG. 9. FIG. 9 also shows an alternate embodiment in which the loads have been tack welded 47 to ensure that the folded over portion of the fusible element are electrically and mechanically connected.

Figure 10:
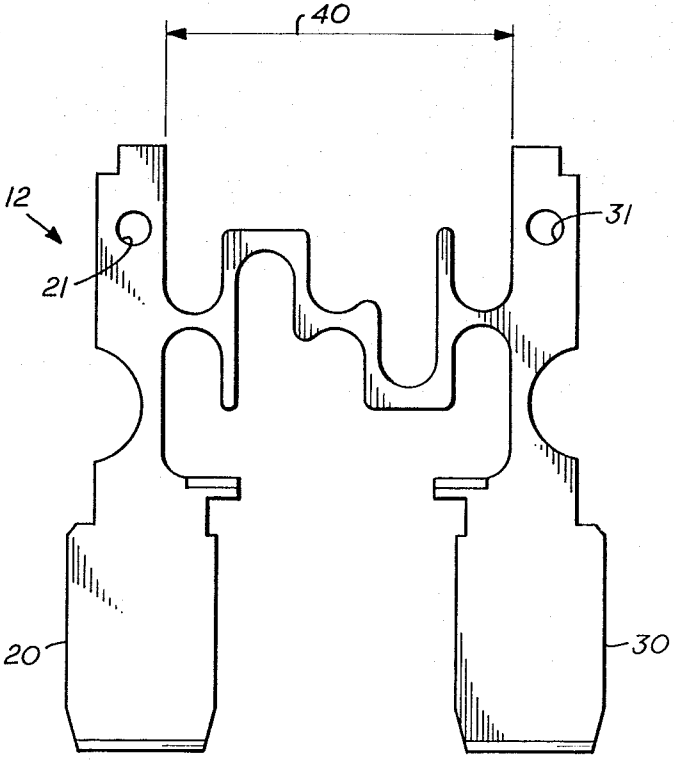
FIG. 10 is a side view of the metal element of yet another embodiment of a fuse according to the present invention.

Fuses of different ratings would incorporate different metal elements of different shapes plated in much the same way as described for the embodiment discussed above. FIG. 10 shows yet another embodiment for a different rating fuse. The desirable time-delayed characteristics may also be achieved by using a fusible element comprised of other combinations of alternating sections of reduced diameter lengths and enlarged portions.

Figure 3:
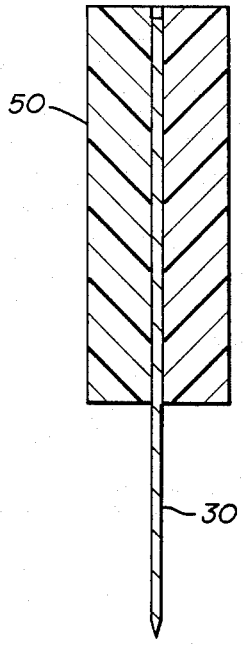
FIG. 3 is a sectional view along lines 3—3 of the fuse shown in FIG. 2.
Figure 3A:
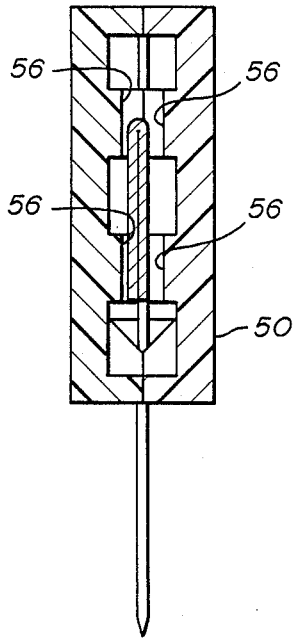
FIG. 3*a* is a sectional view along lines 3*a*—3*a* of the fuse shown in FIG. 2.
Figure 3B:
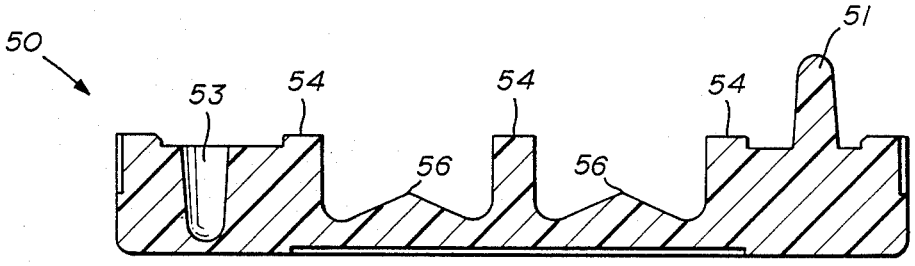

Insulating housing 50 is made from two identical complimentary halves. FIG. 3*b* shows a cross sectional view of the insulating housing along the lines 3*b* of FIG. 2. When assembling fuse 10, metal insert 12 is layed on top of housing 50 as shown in FIG. 2. Tappered boss 51 projects upwardly through hole 21 in terminal 20. This serves to align metal element 12 within housing 50. A symmetrical housing half is then placed over metal element 12 and projection 51 fits through hole 31 in terminal 30, also serving to align metal element with the housing. Tappered boss 51 fits into receptacle 53 in the opposite housing, serving further to align the two housing faces with each other.

Supports 24 and 34 and shoulders 26 and 36 act in a complimentary fashion to hold housing 50 and metal element 12 in place. After the two housing are joined, they are ultrasonically welded together such as is well-known in the art.

Insulating housing 50 incorporates bosses 54 which act to support fuse link 40 so that when fuse link 40 melts during overcurrent or short circuit conditions, it prevents various parts of the terminals from making electrical contact. Housing 50 also incorporates projections 56 which protrude from the inside faces of both halves of housing 50 and support load 42 and 44 of fusible element 40. The purpose of projections 56 is to prevent loads 42 and 44 from twisting during high current or over current conditions.

Plastic casing 50 is made out of a transparent, high-temperature thermoplastic. The transparency allows visual faults in the elements to be readily detected. The high-temperature plastic will maintain structural integrity at elevated operating temperatures.

The fuses 10 are laser etched to provide identification 52 of the amperage rating of the fuse on the top horizontal surface. The fuses may also be laser etched with the date or a code that can be used to determine the date of manufacture and, hence, provides a quality control on the manufacture of fuses and traceability for locating specific batches of fuses. Laser etching, rather than hot stamping or incorporating information in the mold, ensures a more durable marking system. Also using laser etching, the date inscribed on the fuse and other data may be changed on a routine basis, or even daily basis, which is not practical with hot stamping and other types of marking.

Although specific embodiments of the invention have been described above, those skilled in the arts will appreciate that the invention may be practiced in other manners than those shown. For example, the automotive fuse, rather than being a blade-type plug in fuse, may be incorporated into the electrical system by bolting, soldering, clamping, or other means. Although silver is currently the preferred material for plating the fuse terminal blades, tin, copper, or other materials may be used either with or without an undercoat and with or without a barrier coat.

We claim:

1. A fuse, comprising:

a first terminal having first and second portions;

a second terminal having first and second portions;

a fusible element connecting said first and second terminals and having loads attached thereto;

an insulating housing surrounding said fusible element, said loads and said first portions of said first and second terminals, said second portions being exterior of said insulating housing; and selective plating applied to said second portions of said first terminal and said second terminal exterior to said insulating housing.

2. A fuse as in claim 1 wherein said loads are elongated portions of said fusible element which are folded back upon themselves.

3. A fuse as in claim 1 wherein said insulating housing has projection supports to prevent said loads from twisting.

4. A fuse as in claim 1 wherein said loads are additional pieces of metal attached to enlarged portions of said fusible element.

5. A fuse as in claim 1 wherein said insulating housing is comprised of two or more parts with bosses.

6. A fuse as in claim 4 wherein said loads are welded to said enlarged portions of said fusible element.

7. A fuse as in claim 1 wherein said first terminal and said second terminal have notched portions for decreasing the amperage rating of said fuse.

8. A fuse as in claim 1 wherein said fusible element has one or more weak spots to establish the amperage rating of the fuse.

9. A fuse as in claim 1 wherein said selective plating is comprised of a copper undercoat and a tin overcoat.

10. A fuse as in claim 1 wherein said selective plating is comprised of a copper undercoat and a silver overcoat.

11. A fuse as in claim 1 wherein said selective plating is comprised of an undercoat, a barrier coat, and an overcoat.

12. A fuse as in claim 11 wherein said undercoat it copper.

13. A fuse as in claim 11 wherein said barrier coat is nickel.

14. A fuse as in claim 11 wherein said overcoat is silver.

15. A fuse, comprising:

a first terminal having a first and a second portion;

a second terminal having a first and a second portion;

a fusible element connecting said first portions;

a load disposed on said fusible element;

a two-piece insulating housing surrounding said fusible element, load and said first portions, said second portions being exterior of said insulating housing; said housing halves having load supports to prevent said loads from twisting and mating bosses and recesses for assembly of said halves; and selective plating applied to said second portions including an undercoat, barrier coat and overcoat.

16. A fuse, comprising:

a first terminal having first and second portions;

a second terminal having first and second portions;

a fusible link disposed between said first portions of said terminals;

an insulating housing surrounding said fusible link and said first portions of said terminals, said second portions extending form said housing; and said housing further including link supports to prevent said fusible link from bending, twisting or sagging.

17. The fuse of claim 16, wherein said second portions are plated with a conductive metal.

18. The fuse of claim 17, wherein said plating includes an undercoat, a barrier coat and an overcoat.

19. The fuse of claim 18, wherein said undercoat is copper.

20. The fuse of claim 18, wherein said overcoat is tin.

21. The fuse of claim 18, wherein said barrier coat is nickel.

22. The fuse of claim 18, wherein said overcoat is silver.

23. The fuse of claim 17, wherein said loads are disposed on said fusible link.

24. The fuse of claim 23, wherein said housing further includes load supports.

25. A fuse for automotive underhood applications, comprising:

a first terminal and a second terminal having first and second portions;

a fusible link disposed between said first portions of said terminals;

a two-piece insulating housing having first and second case halves surrounding said fusible link and said first portions of said terminals, said second portions being exterior of said insulating housing;

said case halves further including link supports for supporting said fusible link.

26. The fuse of claim 25, wherein said link supports are located on each of said case halves to adjacently engage on opposed sides of said fusible link.

27. The fuse of claim 26, wherein loads are disposed on said fusible link.

28. The fuse of claim 27, wherein said load is disposed on said fusible link between said first portions of said first and second terminals.

29. The fuse of claim 28, wherein said case halves include opposed load supports disposed on the inner surface of said case halves located to prevent said loads from moving into contact with an adjacent load.

30. The fuse of claim 29, wherein said link supports engage said fusible link.

31. The fuse of claim 28, wherein at least one of said case halves includes load supports located to prevent said loads from moving into contact with an adjacent load.

32. The fuse of claim 31, wherein said link supports are oppositely disposed on said case halves adjacent said fusible link.

33. The fuse of claim 32, wherein said link supports and said load supports are disposed in a substantially identical pattern on each said case half.

34. The fuse of claim 25, wherein said case halves each include a projection and a recess.

35. The fuse of claim 34, wherein said projections in each said case half are received within said recesses in each said case half.

36. The fuse of claim 34, wherein each case half has a substantially identical pattern of said projections and recesses disposed thereon.

* * * * *